US005683551A

United States Patent [19]

Meinecke et al.

[11] Patent Number: 5,683,551

[45] Date of Patent: Nov. 4, 1997

[54] APPARATUS AND METHOD FOR SECTIONAL PULP INTRODUCTION TO A PAPERMAKING MACHINE HEADBOX

[75] Inventors: Albrecht Meinecke, Heidenheim; Helmut Heinzmann, Böhmenkirch; Wolfgang Ruf, Heidenheim, all of Germany

[73] Assignee: Voith Sulzer Papiermachinen GmbH, Heidenheim, Germany

[21] Appl. No.: 493,677

[22] Filed: Jun. 22, 1995

[30] Foreign Application Priority Data

Jun. 30, 1994 [DE] Germany ..... 44 22 907.0

[51] Int. Cl.[6] ..... D21F 1/06

[52] U.S. Cl. ..... 162/216; 162/258; 162/336; 162/343

[58] Field of Search ..... 162/336, 343, 162/258, 216

[56] References Cited

U.S. PATENT DOCUMENTS

| | | | |
|---|---|---|---|
| 1,965,579 | 7/1934 | Dennett | 92/38 |
| 2,931,503 | 4/1960 | Clark | 209/211 |
| 3,271,341 | 9/1966 | Mumme | 162/353 |
| 4,384,922 | 5/1983 | Stotz | 162/343 |
| 4,888,094 | 12/1989 | Weisshuhn et al. | 162/343 |
| 4,909,904 | 3/1990 | Kinzler | 162/343 |
| 4,954,249 | 9/1990 | Gero et al. | 209/273 |
| 5,196,091 | 3/1993 | Hergert | 162/343 |
| 5,304,285 | 4/1994 | Meinecke et al. | 162/339 |
| 5,316,383 | 5/1994 | Begemann et al. | 366/160 |
| 5,466,340 | 11/1995 | Begemann et al. | 162/343 |

FOREIGN PATENT DOCUMENTS

| | | |
|---|---|---|
| 2045038 | 12/1991 | Canada . |
| 1 561 697 | 10/1970 | Germany . |
| 36 28 699 | 3/1988 | Germany . |
| 36 39 823 | 6/1988 | Germany . |
| 40 19 593 | 1/1992 | Germany . |
| 92 05 637.7 | 7/1992 | Germany . |
| 42 34 940 | 2/1993 | Germany . |
| 42 11 291 | 10/1993 | Germany . |
| WO 88/01318 | 2/1988 | WIPO . |

*Primary Examiner*—Karen M. Hastings

*Attorney, Agent, or Firm*—Marshall, O'Toole, Gerstein, Murray & Borun

[57] ABSTRACT

A device for the sectional supply of pulp suspension to a headbox of a papermaking machine includes a plurality of main inlet lines from a pulp suspension distributor which are distributed over the width of the machine. A throttle is provided in at least one main inlet line. Downstream of the throttle, in at least one of the main lines, a subsidiary line for conveying a subsidiary stream of liquid, such as a pulp suspension or water, is connected to the main inlet line and disposed at an angle to the main inlet line. This angle between the main pulp stream and the subsidiary stream is chosen so that a small change in the rate of flow of the subsidiary stream will cause a large change in the rate of flow of the total stream (main pulp stream+subsidiary stream) directed in the same direction or in the opposite direction of the stream.

7 Claims, 4 Drawing Sheets

APPARATUS AND METHOD FOR SECTIONAL PULP INTRODUCTION TO A PAPERMAKING MACHINE HEADBOX

BACKGROUND OF THE INVENTION

1. Field of the Invention

The invention relates to devices and methods for the sectional supply of a pulp suspension to a headbox of a papermaking machine.

2. Description of Related Technology

It is known from WO 88/01318 (corresponding to Meinecke et al., U.S. Pat. No. 5,304,285) to supply pulp suspension from a distributor to a headbox utilizing a plurality of lines whereby individual volume flows in the lines can be controlled with adjustable valves.

Sectional introduction of pulp to a headbox utilizing a mixing device is known from German Patent Application 40 19 593 which discloses a mixing device which mixes several partial volume flows in such a way that a constant mixed volume flow is produced. For this purpose, partial volume flows are introduced to a mixer and are controlled as a function of one another by using expensive valve control.

Furthermore, a headbox of a papermaking machine is known from DE 42 11 291 (corresponding to Begemann et al., U.S. Pat. No. 5,316,383) in which a plurality of pulp inlet lines are distributed along a width of the papermaking machine. The properties of the pulp suspension are influenced in individual inlet lines or channels by mixing first and second pulp suspension streams having different properties and different rates of flow. In such a system, the second suspension stream is introduced into the first suspension stream at an angle which is selected to result in a constant volume flow of the resulting mixture of the two partial streams, independent of the ratio of the flow amounts of the two streams. A prerequisite is that a relatively strong throttle be provided after the mixing point of the two streams. In addition to influencing the density of the resulting mixed stream, if the throttle is designed so that it is variable (i.e. an adjustable throttle valve), it is also possible to influence the resulting mixed stream with regard to sectional rate of flow.

In the pulp inlets described in WO 88/01318, DE 40 19 593, and DE 42 11 291, considerable contamination problems are possible because, in order to influence the rate of flow of the sectional volume flows, one of which has a relatively high pulp concentration, one must use a valve, which leads to the formation of fiber "wipes" due to the valve structure, and thus causing an adverse influence on the quality of the produced paper.

SUMMARY OF THE INVENTION

It is an object of the invention to overcome one or more of the problems described above. It is also an object of the invention to provide a device and a method for sectional supply of a pulp suspension to a headbox of a papermaking machine in which it is possible to influence the volume flow between the fiber suspension distributor and headbox in such a way that fiber "wipes" do not occur.

According to the invention, a pulp inlet system for introducing a pulp suspension into a sectional headbox of a papermaking machine includes a plurality of main inlet lines disposed between a pulp suspension distributor and a headbox. The main inlet lines are distributed over a width of the papermaking machine, each of the inlet lines conveying a main pulp stream. The inventive system also includes a throttle disposed in at least one of the main inlet lines and at least one subsidiary line for conveying a liquid subsidiary stream. The subsidiary line is coupled to the main inlet line at a location downstream of the throttle with respect to the direction of flow of the main pulp stream through the system. The subsidiary stream is introduced to the main pulp stream at an angle chosen so that a small change in a rate of flow of the subsidiary stream causes a large change in the rate of flow of a total stream formed by the main pulp stream and the subsidiary stream. This large change in the flow rate of the total stream may be in a direction which is either the same as, or opposite to the direction of flow of the total stream.

A method for the sectional supply of a pulp suspension to a headbox of a papermaking machine according to the invention includes the steps of introducing a pulp suspension to a headbox through a plurality of inlet lines from a pulp suspension distributor, the inlet lines being distributed over a width of the papermaking machine. The inventive method includes throttling the pulp suspension flowing through the inlet lines at at least one location and introducing a subsidiary stream of dilution liquid to the inlet lines at a location downstream of the throttling location with respect to a direction of flow of the pulp suspension through the machine. The introduction of the dilution liquid is performed at an angle chosen so that as a result of a small change of the rate of flow of the subsidiary stream, a large change is produced in the rate of flow of the total stream formed by the pulp suspension and the subsidiary stream. The large change in the total stream flow is in a direction which is one of the same direction as, or an opposite direction to the direction of flow of the total stream.

Other objects and advantages of the invention will be apparent to those skilled in the art from the following detailed description taken in conjunction with the drawings and the appended claims.

DETAILED DESCRIPTION OF THE INVENTION

According to the invention, liquid, preferably a pulp suspension or dilution water defining a subsidiary flow, is fed into a main inlet flow of pulp suspension from a distributor to a headbox (or to a section of the headbox) in such a way that a pulse exchange occurs between the main flow of pulp suspension and the subsidiary flow, so that the total flow rate is reduced with increasing flow rate of the subsidiary flow.

Figure 1:
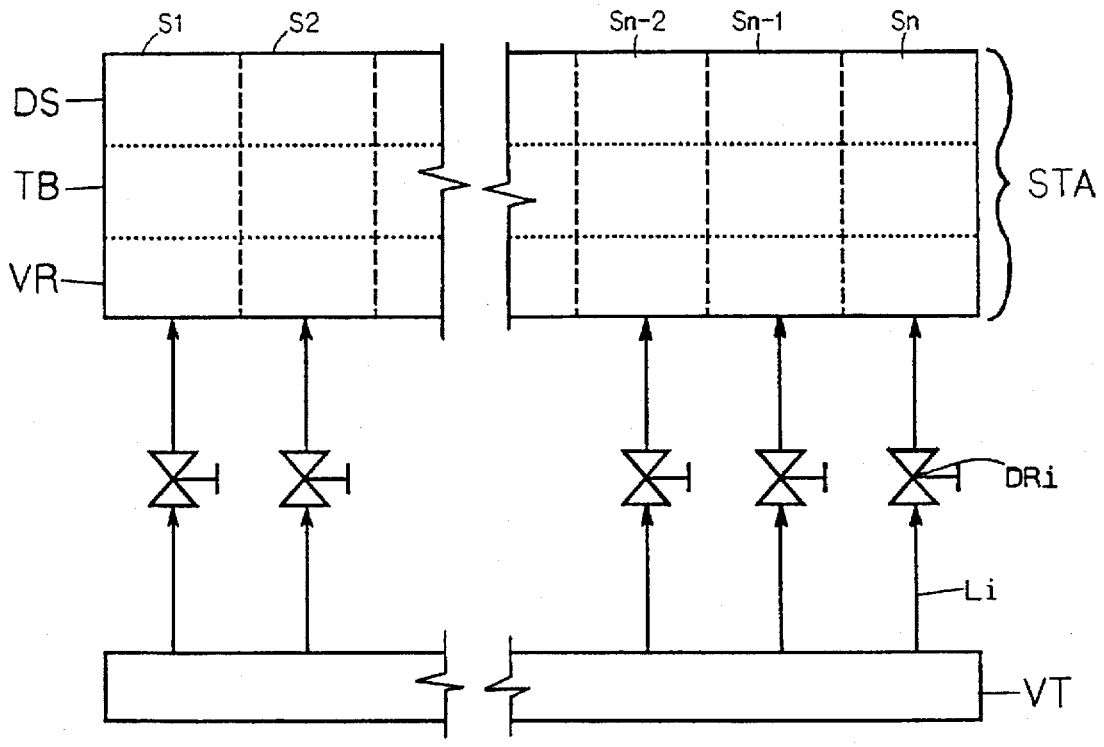
FIG. 1 PRIOR ART
FIG. 1 is a schematic top view of a sectional pulp inlet system into a sectional headbox according to the prior art shown without mixer.

FIG. 1 schematically shows a sectional pulp introduction system known from WO 88/01318 (top view) for flowing pulp into a headbox STA wherein a plurality of sections $S_i$ (designated as $S_1$ to $S_n$ in FIG. 1) of the headbox STA are distributed along the width of the papermaking machine. Each section of the headbox STA has a preliminary chamber VR, followed by a turbulence-producing region TB disposed downstream of the preliminary chamber with respect to a direction of pulp flow through the headbox, and a subsequent (i.e., downstream with respect to a direction of pulp flow through the headbox) outlet nozzle DS. Each section is fed with pulp suspension from a common distributor VT through a plurality of lines $L_i$. Throttle valves $DR_i$ are provided in the lines $L_i$ which make it possible to adjust the pulp volume flow to each section $S_i$ individually, for example, in order to obtain an improved transverse fiber orientation profile.

Figure 2:
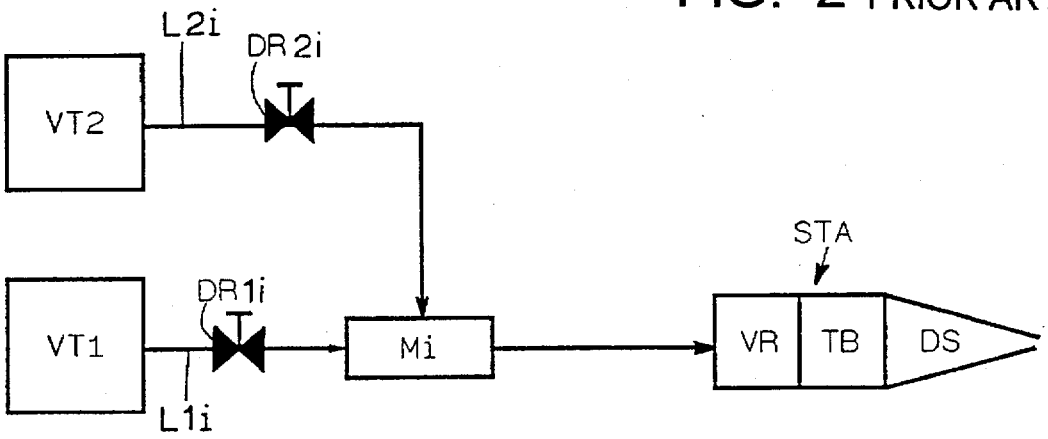
FIG. 2 PRIOR ART
FIG. 2 is a schematic side view of a second embodiment of a sectional pulp inlet system into a sectional headbox according to the prior art shown with a mixer.

FIG. 2 shows a sectional pulp inlet system known from DE 40 19 593 (in side view) in which a pulp suspension from a distributor VT1 is introduced in a controlled manner to a plurality of mixers $M_i$ via a plurality of cooperating lines $L1_i$ with throttle valves $DR1_i$ disposed in each of the lines $L1_i$. A pulp suspension of different concentration, or, for example, dilution water, is introduced into the mixers $M_i$ from another distributor VT2 through a plurality of lines $L2_i$ in a controlled manner through throttle valves $DR2_i$ disposed in each line $L2_i$. The introduction of the individual partial volume flows of lines $L1_i$ and $L2_i$ is controlled via throttle valves $DR1_i$ and $DR2_i$, respectively, in such a way that both the concentration of the pulp suspension and the amount of the total volume flow can be adjusted as described in DE 40 19 593. Also shown in FIG. 2 is a section of a headbox STA (similar to the headbox shown in FIG. 1) connected to the mixer $M_i$ and disposed downstream therefrom with respect to a direction of flow of the pulp suspension through the machine.

Figure 3:
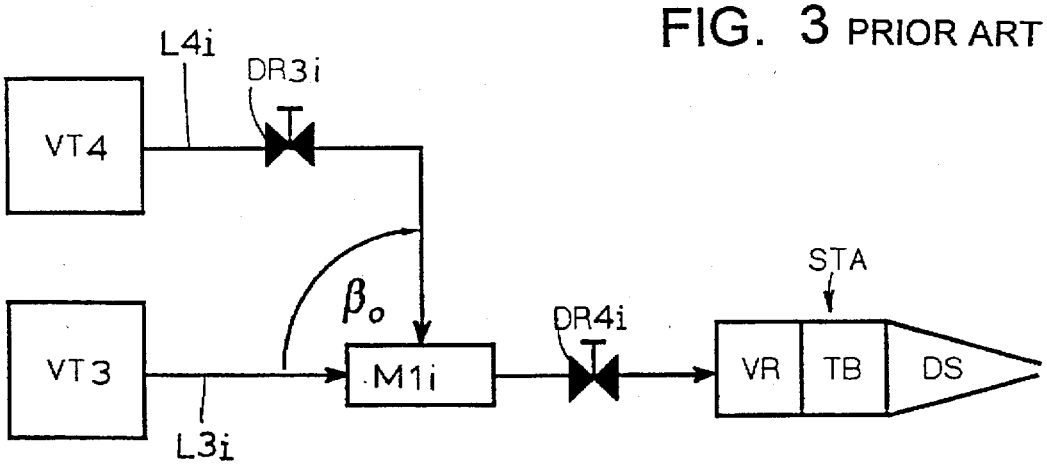
FIG. 3 PRIOR ART
FIG. 3 is a schematic side view of a third embodiment of a sectional pulp inlet system into a sectional headbox according to the prior art shown with a mixer for constant total volume flow.

FIG. 3 shows a sectional pulp inlet system (in side view) known from DE 42 11 291 in which a pulp suspension is introduced to a plurality of mixers $M1_i$ from a distributor VT3 through lines $L3_i$. From another distributor VT4, a pulp suspension of different concentration, or, for example, dilution water, is introduced through lines $L4_i$ through throttle valves $DR3_i$ in a controlled manner to the mixer $M1_i$. The liquid flowing through the lines $L4_i$ is introduced to the pulp suspension flowing through the lines $L3_i$ at an angle $\beta_0$, as described in DE 42 11 291. At the angle $\beta_0$, no change in the total volume flow occurs after mixing when changing the introduced streams through line $L4_i$. However, if the total volume flows must be controlled, then a downstream throttle valve $DR4_i$, which is necessary here, must be adjustable.

All the state of the art embodiments described herein with respect to FIGS. 1–3 are problematic in that a required change of the total volume flow rate can only be achieved by variably throttling the total volume flow rate or by designing the two partial volume flows to be variable. However, such designs increase the danger of contamination which leads to reduction of paper quality as a result of fiber "wiping."

Figure 4:
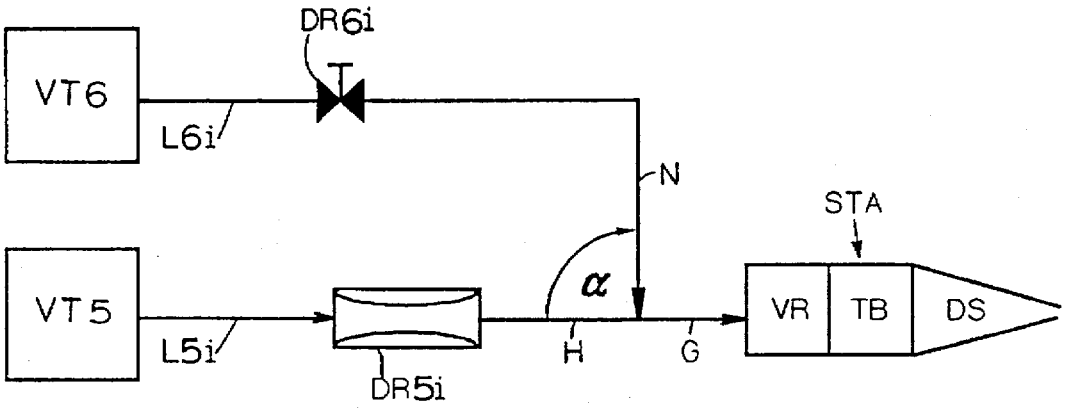
FIG. 4 is a schematic side view of a sectional pulp inlet system according to the invention shown with a headbox section and without a prior mixer.

FIG. 4 shows a pulp inlet system according to the invention having a plurality of main inlet lines disposed between a pulp suspension distributor and a headbox. The main inlet lines are distributed over a width of the papermaking machine, each of the inlet lines conveying a main pulp stream. The system also includes a fixed throttle disposed in at least one of the main inlet lines and at least one subsidiary line for conveying a liquid subsidiary stream. The subsidiary line is coupled to the main inlet line at a location downstream of the throttle with respect to the direction of flow of the main pulp stream through the system. The subsidiary stream is introduced to the main pulp stream at an angle chosen so that a small change in a rate of flow of the subsidiary stream causes a large change in the rate of flow of a total stream formed by the main pulp stream and the subsidiary stream. This large change in the flow rate of the total stream may be in a direction which is either the same as, or opposite to the direction of flow of the total stream.

FIG. 4 illustrates a sectional introduction of a pulp suspension to a headbox STA in which each section of the headbox STA is fed with a pulp suspension primarily by lines $L5_i$, whereby, according to the invention, fixed throttles $DR5_i$ (rather than adjustable throttle valves) are provided in the lines $L5_i$, which can be designed in such a way that they will not be subject to any special contamination. Also, downstream of the throttles $DR5_i$, liquid inlet lines (subsidiary streams) $L6_i$ are provided, which introduce the subsidiary liquid streams N into the main stream H in such a way that small flow changes of the subsidiary stream N will cause large flow changes of the total stream formed downstream of the subsidiary stream introduction.

Figure 5:
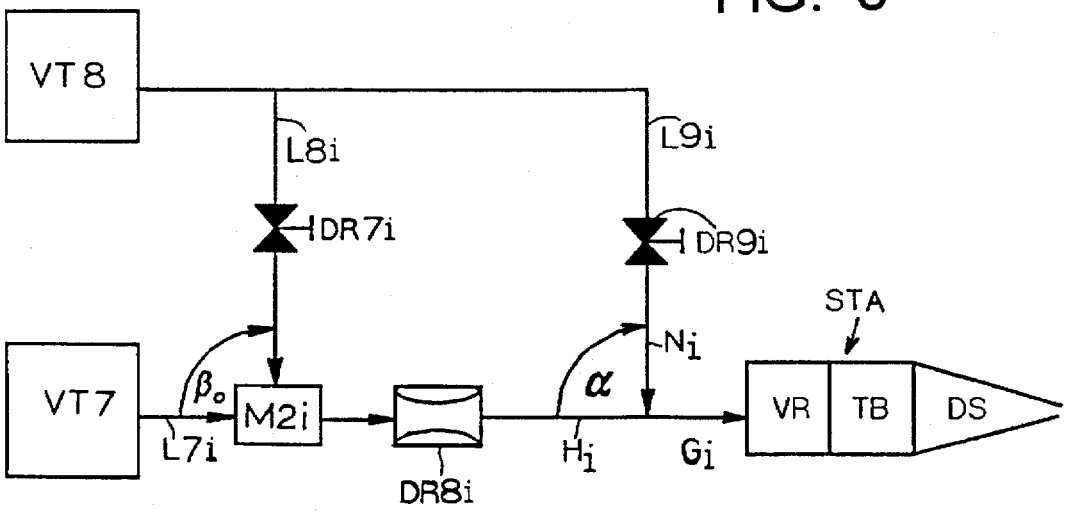
FIG. 5 is a schematic side view of a second embodiment of a sectional pulp inlet system according to the invention having a prior mixer.

FIG. 5 shows a second embodiment of a pulp inlet system according to the invention. In FIG. 5, preconnected mixers $M2_i$ are disposed in the sectional inlet lines. Similar to FIGS. 2 and 3, two distributors VT7 and VT8 are provided for supplying pulp suspension and dilution streams. The distributor VT7 receives a pulp suspension of normal concentration, while dilution fluid of low concentration or without fiber components is introduced into the system via the distributor VT8. In the embodiment shown in FIG. 5, the pulp suspension of high concentration is introduced to the mixers $M2_i$ from the distributor VT7 through lines $L7_i$. In the mixer $M2_i$, a pulp suspension is diluted in a desired manner through introduction of dilution fluid (for example, white water) from the distributor $VT_8$ through lines $L8_i$. The fluid flowing through the lines $L8_i$ is controlled by adjustable throttle valves $DR7_i$. The lines $L8_i$ direct fluid toward the mixer at an angle $\beta_0$. The angle $\beta_0$ is chosen so that no change will occur in the total stream volume as a function of the amount of dilution fluid introduced to the total stream via the line $L8_i$. A fixed throttle $DR8_i$ is preferably disposed after each mixer $M2_i$ (i.e., downstream with respect to a direction of flow of a fluid stream through the pulp inlet system) to ensure a necessary pressure drop.

Liquid, for example dilution fluid, flowing from the distributor VT8 is introduced through lines $L9_i$ to the main pulp streams $H_i$ (leaving the mixer) at an angle $\alpha$. The dilution fluid streams flowing through the lines $L9_i$ are controlled by adjustable throttle valves $DR9_i$. The angle $\alpha$ is chosen so that a small change in the volume flow rate of a subsidiary stream $N_i$ will cause a large change in the volume flow rate of a total stream $G_i$, which flows to a particular headbox section STA.

The following configurations are possible depending on a chosen angle $\alpha$:

a) At $180° \geqq \alpha >> \beta_0$, preferably $\alpha \approx 180°$ and high velocity, low volume of the subsidiary stream, by increasing the subsidiary stream velocity by pulse exchange, a more than proportional reduction of the total stream velocity is achieved by countercurrent flow;

b) At $\beta_0 >> \alpha \geqq 0°$, preferably $\alpha \approx 0°$ and high velocity, low volume of the subsidiary stream, by increasing the subsidiary stream velocity, again a more than proportional increase of the total stream velocity is achieved by co-current flow; and c) At $\alpha \approx 90°$, with the velocity of the subsidiary stream being very large in comparison to the main stream, by increasing the subsidiary stream velocity, the main stream velocity is reduced more than proportionally. A needle jet with locking action may be utilized, producing very strong turbulent flow. In such a needle jet embodiment, the ratio of the cross-section of the main stream to the cross-section of the subsidiary stream is preferably greater than ten (H/N>10).

Figure 6:
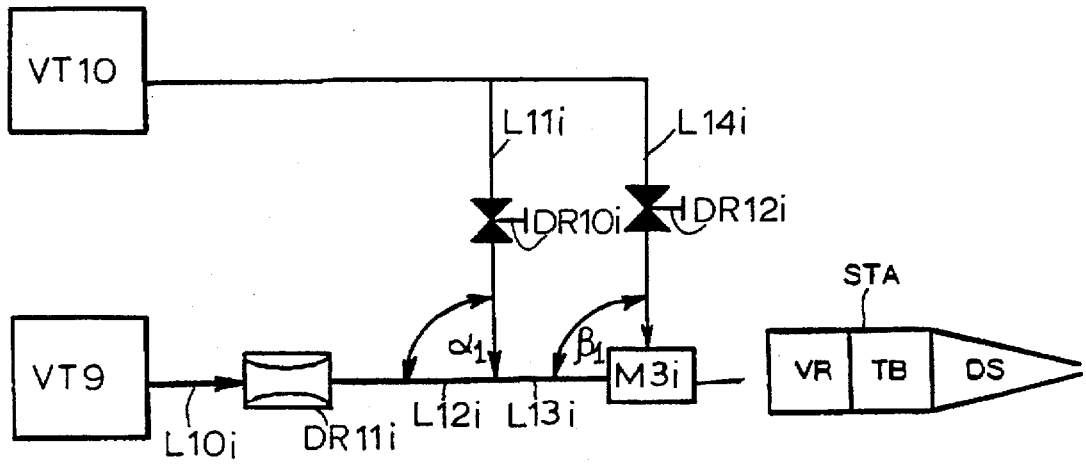
FIG. 6 is a schematic side view of a third embodiment of a sectional pulp inlet system according to the invention.

FIG. 6 shows a third embodiment of a pulp inlet system according to the invention. A portion of the embodiment shown in FIG. 6 is identical to the embodiment shown in FIG. 4, with components VT9, VT10, L10$_i$, DR11$_i$, L11$_i$, DR10$_i$, and $\alpha_1$ identical in structure and function to the components VT5, VT6, L5$_i$, DR5$_i$, L6$_i$, DR6$_i$, and $\alpha$, respectively, shown in FIG. 4. Also, similar to the angle $\alpha$ shown in the embodiment of FIG. 4, the angle $\alpha_1$ is chosen so that a small change in the velocity of a subsidiary stream in at least one liquid inlet line L11$_i$ will cause a large change in the velocity of a total stream in a line L13$_i$ formed by the subsidiary stream in the liquid inlet line L11$_1$ and the main pulp stream in the line L12$_i$.

Furthermore, a total stream flowing through at least one of the lines L13$_i$ is introduced to a mixer M3$_i$. The mixer M3$_i$ is disposed in at least one of lines L13$_i$ at a location downstream of the coupling of the line L12$_i$ with the liquid inlet line L11$_i$. A secondary inlet line L14$_i$ is coupled to the mixer M3$_i$ for the introduction of at least one of a pulp suspension having a composition different from the main pulp stream and dilution water into the mixer M3$_i$. The fluid flowing through the secondary inlet line L14$_i$ is controlled by an adjustable throttle valve DR12$_i$. The secondary inlet line L14$_i$ directs fluid toward the mixer M3$_i$ at an angle $\beta_1$.

A special advantage of the embodiments according to the invention disclosed herein lies in the fact that with all embodiments, adjustable throttle valves which tend to contaminate the pulp stream are not disposed in the high concentration suspension stream, but are rather disposed in low concentration or dilution fluid stream. Preferably, in connection with a concentration-regulation of the sectional streams, even a slight change of the pulp concentration of a corresponding section will not cause any problems, because this can be compensated for by adjusting of the concentration of the pulp suspension of the main stream which includes an upstream mixer.

The foregoing detailed description is given for clearness of understanding only, and no unnecessary limitations should be understood therefrom, as modifications within the scope of the invention will be apparent to those skilled in the art.

We claim:

1. A method for the sectional supply of a pulp suspension to the headbox of a papermaking machine, said method comprising the following steps:

(a) introducing pulp suspension to a headbox through a plurality of inlet lines from a pulp suspension distributor, said inlet lines being distributed over a width of the papermaking machine;

(b) throttling, through a fixed throttle, the pulp suspension flowing through at least one inlet line at at least one location;

(c) introducing a subsidiary stream of dilution liquid to the at least one inlet line at a location downstream of the fixed throttle with respect to a direction of flow of the pulp suspension through the machine, the at least one inlet line is devoid of a throttle disposed downstream of where the at least one subsidiary stream is introduced to the at least one inlet line, said introduction of the dilution liquid performed at an angle chosen so that as a result of a small change of a velocity of the subsidiary stream, a large change is produced in a velocity of the total stream formed by the pulp suspension and the subsidiary stream, said large change in the velocity of the total stream directed in one of the same direction as or opposite direction to the direction of flow of the total stream.

2. A pulp inlet system for introducing a pulp suspension into and in combination with a sectional headbox of a papermaking machine, said system comprising:

(a) a plurality of main inlet lines disposed between a pulp suspension distributor and a headbox, said main inlet lines distributed over a width of a papermaking machine, each of said inlet lines for conveying a main pulp stream;

(b) a fixed throttle disposed in at least one of the main inlet lines; and (c) at least one subsidiary line for conveying a liquid subsidiary stream, said subsidiary line having means for influencing the velocity of the subsidiary stream and being coupled to the at least one main inlet line at a location downstream of the fixed throttle with respect to a direction of flow of the main pulp stream through the system, the at least one main inlet line being void of a throttle disposed downstream of the coupling of the at least one subsidiary line and the at least one main inlet line, the subsidiary stream introduced to the main pulp stream flowing through the at least one main inlet line at an angle chosen so that a small change in a velocity of the subsidiary stream causes a large change in the velocity of a total stream formed by the main pulp stream and the subsidiary stream, said large change in the velocity of the total stream being in a direction which is one of the same as and oppositely directed to the direction of flow of the total stream.

3. The pulp inlet system of claim 2 further comprising:

(a) a mixing unit disposed in the at least one main inlet line at a location upstream of the coupling of the main inlet line with the at least one subsidiary line with respect to the direction of flow of the main pulp stream;

(b) at least one secondary inlet line coupled to each mixing unit for the introduction of at least one of a pulp suspension having a composition different from the main pulp stream and dilution water into the mixing unit; and (c) means for influencing a particular velocity in the at least one secondary inlet line.

4. The pulp inlet system of claim 2 wherein the subsidiary stream angle is chosen to result in a direction of flow of the subsidiary stream that is one of the same direction as and an opposite direction to a direction of flow of the main pulp stream.

5. The pulp inlet system of claim 2 structured and arranged so that a velocity of the subsidiary stream flowing into the main pulp stream is considerably larger than a velocity of the main pulp stream and that a volume flow of the subsidiary stream is considerably smaller than a volume flow of the main stream.

6. The pulp inlet system of claim 2 wherein:

(a) the main pulp stream and the subsidiary stream form a right angle at the coupling of said streams;

(b) the ratio of the cross-section of the main pulp stream to the cross-section of the subsidiary stream is greater than ten (10) forming a needle jet; and (c) the velocity of the subsidiary stream is larger than the velocity of the main pulp stream.

7. The pulp inlet system of claim 3 wherein:

(a) the subsidiary stream angle is chosen to result in a direction of flow of the subsidiary stream that is one of the same direction as and an opposite direction to a direction of flow of the main pulp stream;

(b) the fixed throttle is disposed downstream of the mixing unit with respect to the direction of flow of the main pulp stream; and (c) the velocity of the subsidiary stream is small in comparison to the velocity of the main stream.

* * * * *